US006176107B1

(12) United States Patent
Pernick et al.

(10) Patent No.: US 6,176,107 B1
(45) Date of Patent: Jan. 23, 2001

(54) CIRCULAR KNITTING MACHINE WITH REPLACEABLE MEMBER FOR RESTRICTING VERTICAL MOVEMENT OF SINKERS

(75) Inventors: Bruce M. Pernick, Stamford, CT (US); Philip Renda, Charlotte; Alan Gutschmit, Troy, both of NC (US)

(73) Assignee: Monarch Knitting Machinery Corp., Glendale, NY (US)

( * ) Notice: Under 35 U.S.C. 154(b), the term of this patent shall be extended for 0 days.

(21) Appl. No.: 09/321,342

(22) Filed: May 27, 1999

(51) Int. Cl.[7] ..... D04B 15/06
(52) U.S. Cl. ..... 66/107; 66/104; 66/115
(58) Field of Search ..... 66/8, 217, 91, 66/92, 93, 104, 106, 107, 115

(56) References Cited

U.S. PATENT DOCUMENTS

| | | | | |
|---|---|---|---|---|
| 1,634,682 | * | 7/1927 | Page | 66/104 |
| 2,120,752 | * | 6/1938 | Jones | 66/104 |
| 2,120,796 | * | 6/1938 | Coile | 66/104 |
| 3,230,742 | * | 1/1966 | Roedel | 66/104 |
| 3,377,823 | * | 4/1968 | McDonough | 66/104 |
| 4,459,830 | * | 7/1984 | Tsuchiya et al. | 66/140 S |
| 4,519,221 | * | 5/1985 | Hirano | 66/107 |
| 4,532,781 | * | 8/1985 | Buck | 66/104 |
| 4,546,623 | * | 10/1985 | Kuhn et al. | 66/104 |
| 4,574,596 | * | 3/1986 | Engelfried et al. | 66/104 |
| 4,665,718 | * | 5/1987 | Jelinek et al. | 66/9 R |
| 4,765,155 | * | 8/1988 | Pernick | 66/8 |
| 5,182,927 | * | 2/1993 | Pernick | 66/104 |
| 5,279,133 | * | 1/1994 | Plath | 66/104 |
| 5,477,707 | * | 12/1995 | Renda et al. | 66/93 |
| 5,564,293 | * | 10/1996 | Black et al. | 69/19.2 |
| 5,577,401 | * | 11/1996 | Pernick | 66/8 |
| 5,609,044 | * | 3/1997 | Tacy | 66/115 |

* cited by examiner

*Primary Examiner*—Danny Worrell
(74) *Attorney, Agent, or Firm*—Alston & Bird LLP

(57) ABSTRACT

A readily replaceable restricting member is within an annular receiving channel that is defined by a cylindrical portion of a circular knitting machine, and the restricting member is operative to restrict at least upward or downward movement of the sinkers of the circular knitting machine. The sinkers are operative for reciprocating radially relative to the cylindrical portion and the restricting member such that sliding contact is defined between the sinkers and the biased restricting member. In accordance with several of the embodiments of the present invention, each of the sinkers comprises an upper nib and a lower nib, a radially extending slot is defined between the upper nib and the lower nib, and the slot is open at the leading edge of the sinker. In accordance with several embodiments of the present invention, the restricting member is in the travel paths of the sinkers so that the biased restricting member is at least partially received within the radially extending slots in response to the radial reciprocating of the sinkers. In various combinations, upper surfaces of the lower nibs contact the restricting member, lower surfaces of the upper nibs contact the restricting member, and lower surfaces of the sinkers contact the restricting member, so that movement of the sinkers is restricted. In accordance with several embodiments of the present invention, the restricting member is biasedly engaged within the receiving channel.

51 Claims, 4 Drawing Sheets

CIRCULAR KNITTING MACHINE WITH REPLACEABLE MEMBER FOR RESTRICTING VERTICAL MOVEMENT OF SINKERS

FIELD OF THE INVENTION

The invention relates to circular knitting machines and their sinkers. In particular, the invention relates to controlling the vertical motion of radially reciprocating sinkers of circular knitting machines.

BACKGROUND OF THE INVENTION

Circular knitting machines are widely used to produce knitted fabric, such as knitted fabric that is tubular. A conventional circular knitting machine includes a vertically extending cylinder, and multiple sinkers and latch needles that extend around and move relative to the upper end of the cylinder. The sinkers reciprocate radially and the latch needles reciprocate vertically in a cooperative fashion to produce knitted fabric. For example, U.S. Pat. Nos. 4,459,830; 4,765,155; 5,182,927; 5,477,707; 5,577,401 and 5,609,044 disclose circular knitting machines, and each of those patents is incorporated herein by reference.

It is important to control accurately the vertical movement of the sinkers of a circular knitting machine. For example, U.S. Pat. Nos. 1,684,682; 2,120,796; 3,230,742; 3,377,823; 4,519,221; 4,665,718 and 5,564,291 discloses circular knitting machine cylinders having annular ledges that at least partially define the paths of associated sinkers. The sinkers have upper and lower arms that bear upon opposite surfaces of the ledges.

Notwithstanding past improvements to circular knitting machines, at least some modern circular knitting machines experience problems when sinkers encounter deposits of lint, dirt, or the like, on an upper surface of the circular knitting machine cylinder upon which the sinkers slide. Accumulations on the cylinder upper surface can cause the sinkers to ride upward, resulting in "sinker lines" in the knitted fabric. The presence of sinker lines is a defect that knitters wish to avoid. Efforts have been made to avoid this problem by trying to keep the upper regions of the cylinder clean by forcing air in and around the vertically and radially extending slots in which the sinkers at least partially reside. Whereas this approach works fairly well, it is not an infallible solution, and this approach requires extra parts such as fans, compressors, ducting, filters and so forth.

Downward motion of the sinkers is also undesirable because it may lead to sinker lines or problems such as smashing of sinker parts and other parts of the circular knitting machine. In machines that have been run for some time, downward motion of the sinkers can occur due to wear between the sinkers and the cylinder upper surface. Over time, this wear causes grooves to form in the upper surface of the cylinder, and the sinkers may ride downwardly into grooves. Whereas it is known in the art to harden the upper surface of the cylinder, or a portion thereof, so as to reduce the wearing and resulting grooves, such hardening can be expensive, and can in some cases cause warping and tolerance problems.

Accordingly, there is a need for an improved mechanism for restricting vertical movement of sinkers.

SUMMARY OF THE INVENTION

The present invention restricts undesirable vertical movement of sinkers, and provides other advantages, while simultaneously avoiding problems with binding or excessive friction. More specifically, at least one readily replaceable restricting member is carried by a cylindrical portion of a circular knitting machine and is operative to restrict at least upward or downward movement of the sinkers. For a circular knitting machine having a cylinder with a cylinder top ring, the cylindrical portion to which the restricting member is mounted is preferably the cylinder top ring. For a circular knitting machine in which the cylinder is not equipped with a cylinder top ring, the cylindrical portion to which the restricting member is mounted is preferably the upper portion of the cylinder.

In accordance with one aspect of the present invention, the restricting member is biasingly engaged to the cylindrical portion such that the biased restricting member extends at least partially around the cylindrical axis of the cylindrical portion. The sinkers are operative for reciprocating radially relative to the cylindrical portion and the biased restricting member such that sliding contact is defined between the sinkers and one or more bearing-like surfaces of the biased restricting member.

In accordance with one aspect of the present invention, the biased restricting member is manually bent and thereafter released so that the bias of the biased restricting member causes it to become biasingly engaged to the cylindrical portion. Most preferably, the biased restricting member is released so that the biased restricting member becomes biasingly engaged within a receiving channel that is defined by the cylindrical portion and encircles the cylindrical axis of the cylindrical portion. It is preferable for the biased restricting member to remain stationary within the receiving channel during the reciprocating of the sinkers.

In accordance with one aspect of the present invention, the cylindrical portion comprises a plurality of spaced-apart, radially extending protrusions, and a plurality of radially extending slots are defined between the protrusions. The slots are operative for at least partially receiving the reciprocating sinkers, and the protrusions at least partially define the receiving channel such that the receiving channel and the biased restricting member at least partially bisect the slots.

In accordance with some of the embodiments of the present invention, an interior surface of the cylindrical portion defines an opening to the receiving channel. In accordance with other embodiments of the present invention, an exterior surface of the cylindrical portion defines an opening to the receiving channel. Both types of openings to the receiving channel extend at least partially around the cylindrical axis of the cylindrical portion so that the biased restricting member can be readily introduced into and removed from the receiving channel, whereby the biased restricting member is readily replaceable.

In accordance with one aspect of the present invention, the biased restricting member may be biased toward a substantially straight configuration, in which case the biased restricting member has opposite ends. The opposite ends of the biased restricting member may abut in an end-to-end manner when the biased restricting member is properly positioned within the receiving channel. Alternatively, the opposite ends of the biased restricting member may not abut in an end-to-end manner when the biased restricting member is properly positioned within the receiving channel, in which case the biased restricting member can be characterized as having a discontinuous circumference.

In accordance with another aspect of the present invention, the biased restricting member defines a relaxed diameter while the biased restricting member is separate from the cylindrical portion. As one example, the biased restricting member may be in the form of a hoop. Such a hoop may be formed, for example, by joining the opposite ends of a biased restricting member, such that the opposite ends define an end-to-end arrangement. As another example, the opposite ends of a biased restricting member are not joined, but the biased restricting member at least partially defines an arcuate configuration while separate from the cylindrical portion and relaxed, and the arcuate configuration defines the relaxed diameter. When the receiving channel has an outwardly facing opening, the relaxed diameter is preferably smaller than the diameter of the receiving channel. When the receiving channel has an inwardly facing opening, the relaxed diameter is preferably larger than the diameter of the channel.

When the biased restricting member is not in the form of a hoop, or the like, it may be preferred for the length of the biased restricting member to be greater than the circumference of the receiving channel, so as to maximize the overlapping of the biased restricting member within the receiving channel. Further, it may be preferred to have two or more separate biased restricting members in the receiving channel so as to provide at least a doubled configuration. The overlapping or doubled configurations increase the area of contact between the sinkers and the biased restricting member or members, so as to prolong the life of, and increase the effectiveness of, the biased restricting member or members.

In accordance with one aspect of the present invention, upper surfaces of the sinkers contact bearing-like surfaces of at least one biased restricting member so that upward movement of the sinkers is restricted. In accordance with another aspect of the present invention, lower surfaces of the sinkers contact the bearing-like surfaces of at least one biased restricting member so that downward movement of the sinkers is restricted. In accordance with another aspect of the present invention, upper and lower surfaces of the sinkers contact the bearing-like surfaces of one or more biased restricting members so that both upward and downward movement of the sinkers is restricted.

In accordance with another aspect of the present invention, each of the sinkers comprises an upper nib and a lower nib, a radially extending slot is defined between the upper nib and the lower nib, and the slot is open at the leading edge of the sinker. At least one biased restricting member is in the travel paths of the sinkers so that the biased restricting member is at least partially received within the radially extending slots in response to the radial reciprocating of the sinkers. In one embodiment of the present invention, upper surfaces of the lower nibs of the sinkers contact bearing-like surfaces of at least one biased restricting member so that upward movement of the sinkers is restricted. In accordance with another embodiment of the present invention, lower surfaces of the upper nibs of the sinkers contact bearing-like surfaces of at least one biased restricting member so that downward movement of the sinkers is restricted. In accordance with another embodiment of the present invention, upper surfaces of the lower nibs and lower surfaces of the upper nibs of the sinkers contact bearing-like surfaces of at least one biased restricting member so that both upward and downward movement of the sinkers is restricted.

In accordance with another aspect of the present invention, lower surfaces of the lower nibs of the sinkers contact bearing-like surfaces of at least one restricting member so that downward movement of the sinkers is restricted. In accordance with this aspect of the present invention, the slots in the sinkers are optional. Further, the restricting member may or may not be biased, and the restricting member may be positioned as described above, or the restricting member may be positioned differently. As one specific example, the restricting member may be positioned in a channel having an annular opening that is defined by a surface around and from which the above-mentioned plurality of spaced-apart, radically extending protrusions extend. It is within the scope of the present invention for a circular knitting machine to include a combination of different types of restricting members and/or a combination of differently positioned restricting members.

A restricting member may include one or more springs or pieces of wire. A significant advantage of the use of wires and/or springs as the restricting member is that the wires and springs are relatively inexpensive and easy to replace when worn. Ideally the wires or springs would last as long as possible, but as a minimum they only need to last as long as the sinkers, which are consumable elements that must be replaced every few months.

The present invention provides numerous other advantages. For example, in accordance with some of the embodiments of the present invention a biased restricting member restrains the sinkers from moving upwardly, which prevents the formation of sinker lines in the knitted fabric. Further, because the biased restricting member restrains the sinkers from moving upwardly, the need for trying to keep the upper regions of the cylindrical portion clean by means of fans and compressed air is at least partly reduced.

As an additional example of an advantage, in accordance with some of the embodiments of the present invention a restricting member restrains the sinkers from moving downwardly, thus bearing the weight of the sinkers and any downward forces imposed by knitted fabrics and yarn so as to prevent undesired wearing and groove formation in the upper surface of the cylindrical portion. Thus, the restricting member can eliminate or reduce the need to replace the cylindrical portion, and further eliminates or reduces the need for hardening an upper portion of the cylindrical portion, which is expensive and can sometimes cause warping and tolerance problems.

BRIEF DESCRIPTION OF THE DRAWINGS

The foregoing and other advantages and features of the invention, and manners in which the same are accomplished, will become apparent from the following detailed description of the invention taken in conjunction with the accompanying drawings which illustrate preferred and exemplary embodiments, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

First Embodiment

Figure 1:
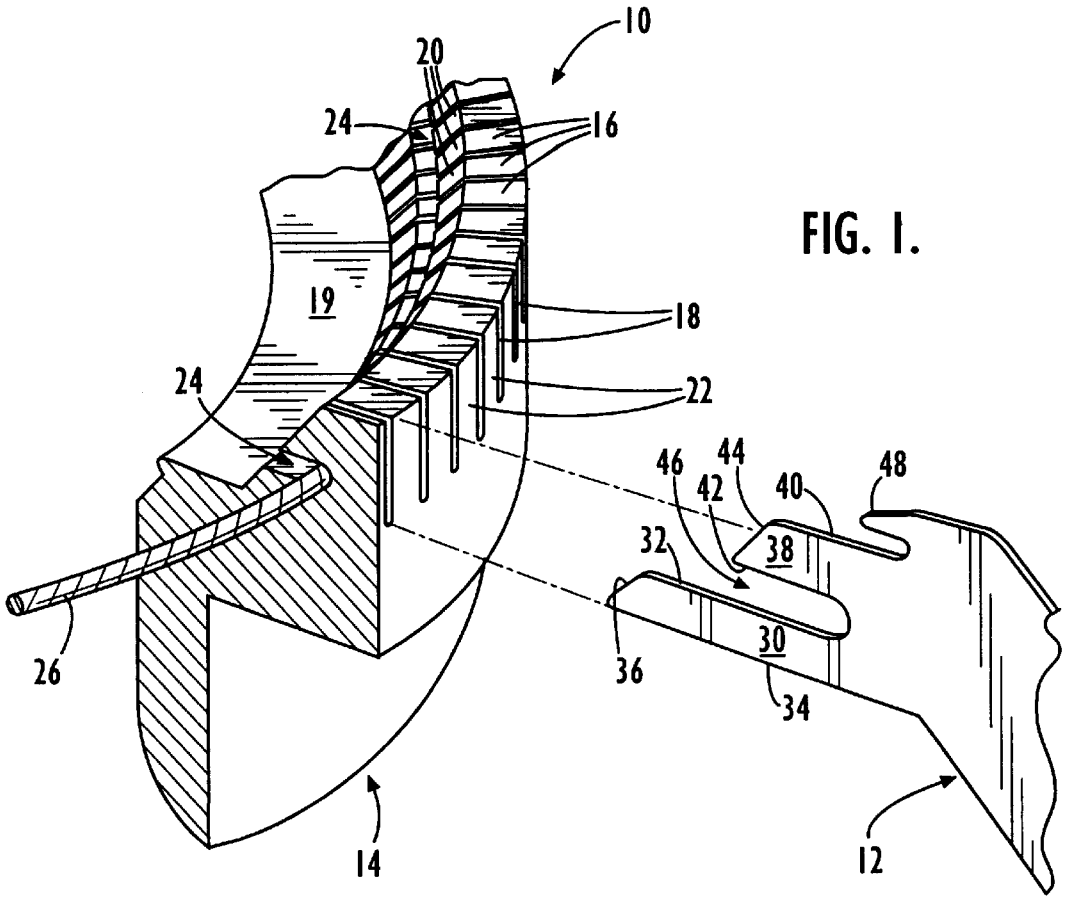
FIG. 1 is a sectional perspective view of a portion of a cylinder assembly of a circular knitting machine, with a portion of a representative sinker exploded therefrom, in accordance with a first embodiment of the present invention.

FIG. 1 is a sectional perspective view of a portion of a cylinder assembly 10 of a circular knitting machine (not shown), with a portion of a sinker 12 exploded therefrom, in accordance with the first embodiment of the present invention. The cylinder assembly 10 includes a cylindrical portion 14 that extends around a cylindrical axis, which is the axis about which the cylindrical portion is defined. For circular knitting machines that have a cylinder top ring at the top of the cylinder of the circular knitting machine, the cylindrical portion 14 is preferably the cylinder top ring. For circular knitting machines in which the cylinder is not equipped with a cylinder top ring, the cylindrical portion 14 is preferably the upper portion of the cylinder.

The cylindrical portion 14 includes multiple upwardly extending protrusions 16, which also extend radially. The upwardly extending protrusions 16, only a few of which are shown or identified with a reference numeral in FIG. 1, together encircle the cylindrical axis of the cylindrical portion 14. Multiple upwardly extending slots 18, which also extend radially, are defined between the upwardly extending protrusions 16. The multiple upwardly extending slots 18, only several of which are shown or identified with a reference numeral in FIG. 1, together encircle the cylindrical axis of the cylindrical portion 14. Each slot 18 has, or is defined between, opposite and parallel side walls of adjacent upwardly extending protrusions 16. The parallel side walls of the slots 18 extend upwardly and radially. For each upwardly extending slot 18, the parallel side walls thereof extend upward from opposite ends of a generally horizontal base wall that provides the base of the slot. The cylindrical portion 14 further includes an upper face 19 that encircles the cylindrical axis of the cylindrical portion and is coplanar with the base walls of the slots 18. The upwardly extending protrusions 16 encircle the upper face 19. Whereas only a single sinker 12 is shown in FIG. 1, each of the upwardly extending slots 18 receives a different sinker, such that multiple sinkers encircle the cylindrical axis of the cylindrical portion 14.

Each of the upwardly extending protrusions 16 has an interior surface 20 that faces the cylindrical axis of the cylindrical portion 14. The interior surfaces 20, only a few of which are shown or identified with a reference numeral in FIG. 1, together encircle the cylindrical axis of the cylindrical portion 14. Whereas the interior surfaces 20 are separated by the upwardly extending slots 18, the interior surfaces 20 can be characterized as together providing a composite interior surface 20 that generally faces and encircles the cylindrical axis of the cylindrical portion 14, and that extends upward from the upper face 19.

Each of the upwardly extending protrusions 16 further has an exterior surface 22. The exterior surfaces 22, only a few of which are shown or identified with a reference numeral in FIG. 1, together encircle the cylindrical axis of the cylindrical portion 14. Whereas the exterior surfaces 22 are separated by the upwardly extending slots 18, the multiple exterior surfaces 22 can be characterized as together providing a composite exterior surface 22 that generally faces away from and encircles the cylindrical axis of the cylindrical portion 14.

Each of the upwardly extending protrusions 16 defines a receiving channel 24 that can be characterized as being in the form of a horizontally or sideways oriented U-shaped channel. Each receiving channel 24 has an opening that is defined by the respective interior surface 20 and oriented toward the cylindrical axis of the cylindrical portion 14. As best be seen in FIG. 2, each receiving channel 24 has, or is defined by, opposite and parallel upper and lower interior walls of the respective upwardly extending protrusion 16. The parallel walls of the receiving channels 24 extend horizontally. The parallel walls of each receiving channel 24 extend from opposite ends of an arcuate wall, which is an interior wall of the respective upwardly extending protrusion 16 and provides the base of the receiving channel. The receiving channels 24, only a few of which are shown or identified with a reference numeral in FIG. 1, together encircle the cylindrical axis of the cylindrical portion 14. The multiple receiving channels 24 can be characterized as together providing a composite receiving channel 24 that encircles the cylindrical axis of the cylindrical portion 14.

The cylinder assembly 10 further includes a biased restricting member 26, which is preferably a biased elongate, arcuate, or hoop-like member, such as a spring or a spring-like piece of wire, or the like. The biased restricting member 26 is positioned in the composite receiving channel 24 and functions to provide bearing-like surfaces that are engaged by the sinkers 12 and restrict undesired vertical movement of the sinkers, as will be discussed in greater detail below. One example of an acceptable biased restricting member 26 is a length of wire having opposite ends. In accordance with one version of the first embodiment of the present invention, the piece of wire is biased toward a straight configuration, such that when the wire is free from the composite receiving channel 24 the wire extends substantially straight. As a result, when the wire is manually placed in the composite receiving channel 24, the wire seeks to return to its straight configuration, which causes the wire to become biasedly engaged to the arcuate walls that define the base of the composite receiving channel, whereby the wire is engaged to the cylindrical portion 14. Stated more generally, a somewhat straight section of wire is bent around the inside periphery of the cylindrical portion 14 so that the wire is biased into place.

In accordance with another version of the first embodiment of the present invention, the wire is biased toward a configuration in which the wire defines an arcuate or somewhat circular configuration, or the like. The relaxed diameter of the arcuate or somewhat circular wire is preferably larger than the diameter of the composite receiving channel 24, so that the wire becomes biasedly engaged to the arcuate walls that define the base of the composite receiving channel when the wire is inserted into the composite receiving channel. The opposite ends of any such piece of wire may not be joined to one another, so that the wire has a discontinuous circumference. Alternatively, they can be joined such as by brazing or welding the ends together. The diameter of the composite receiving channel 24 can be characterized as being approximately the diameter defined by the arcuate walls that define the base of the composite receiving channel.

In accordance with another version of the first embodiment of the present invention, the biased restricting member 26 is an elongate helical spring that is wound so that it is in the form of an elongate, somewhat tube-like member which may be biased toward any of the configurations described above with respect to the pieces of wire. Additionally, the opposite ends of the tube-like member may be attached to one another, such as by welding, so that the helical spring is in the form of a hoop or circle, or the like. In accordance with the first embodiment of the present invention, it is preferred for the relaxed diameter of the hoop or circle to be greater than the diameter of the receiving channel 24, so that the hoop or circle becomes biasedly engaged to the arcuate walls that define the base of the composite receiving channel 24 when the helical spring is introduced into the composite receiving channel.

Figure 2:
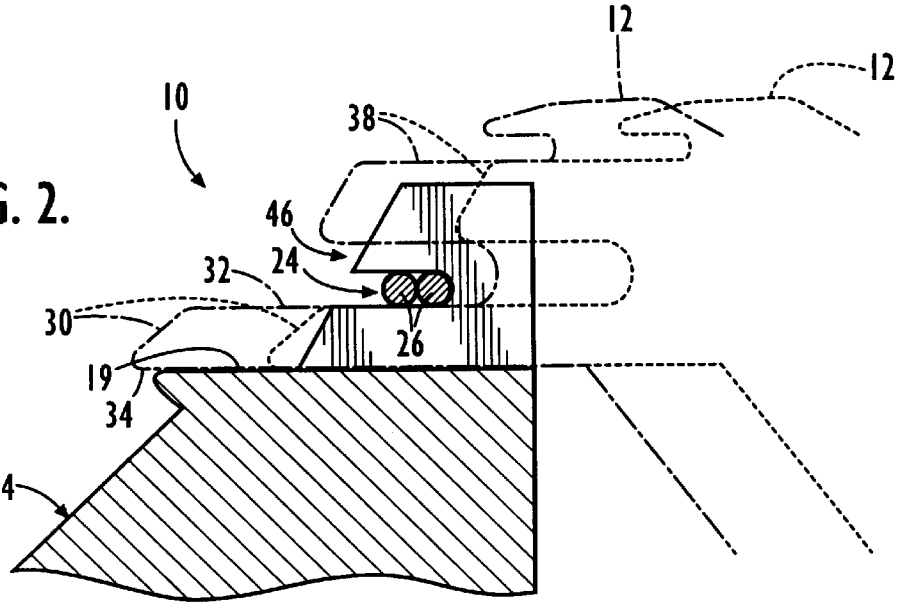
FIG. 2 is a sectional view of a portion of the cylinder assembly of FIG. 1, wherein two positions of the sinker are shown in broken lines, in accordance with the first embodiment of the present invention.

When the biased restricting member 26 is an elongate member having opposite ends that are not joined to one another, the length of the biased restricting member may be greater than the circumference of the composite receiving channel 24, so that at least a portion of the biased restricting member overlaps itself to provide a doubled configuration, as illustrated in FIG. 2. The circumference of the composite receiving channel 24 can be characterized as being approximately the circumference defined by the arcuate walls that define the base of the composite receiving channel.

It may be preferred for the length of the biased restricting member 26 to be at least two to three, or more times greater than the circumference of the composite receiving channel 24, so as to maximize the overlapping of the biased restricting member 26 within the composite receiving channel. Further, it may be preferred to have two or more separate biased restricting members 26 in the receiving channel to provided at least a doubled configuration in which an inner of the biased restricting members is biasedly engaged to the arcuate walls that define the base of the composite receiving channel 24 as described above, and an outer of the biased restricting members is biasedly engaged to the inner of the biased restricting members.

Throughout this Detailed Description of the Invention section of this disclosure, unless expressly stated otherwise or understood otherwise by those skilled in the art, reference to a biased restricting member 26 within the composite receiving channel 24 is to be considered to alternatively include all of the variations of biased restricting members discussed above, including, but not limited to, a single biased restricting member that does not overlap itself within the composite receiving channel, a biased restricting member that overlaps itself within the composite receiving channel, and two or more biased restricting members contemporaneously within the composite receiving channel and providing a doubled configuration, such as that illustrated in FIG. 2.

As best seen in FIG. 2, in accordance with the present invention it is preferred for there to be little, if any, clearance between the biased restricting member 26 and the parallel walls of the composite receiving channel 24. Thus, the upper walls of the composite receiving channel 24 restrict upward movement of the biased restricting member 26 and the lower walls of the composite receiving channel restrict downward movement of the biased restricting member. Therefore, the biased restricting member 26 remains substantially stationary while within the composite receiving channel 24, even while the sinkers 12 are in motion, as will be discussed in greater detail below. Whereas the members 26 are shown as have substantially circular cross-sectional configurations in FIG. 2, it is also within the scope of the present invention for biased restricting members to have other cross-sectional configurations, such as rectangular, or the like.

The sinker 12 illustrated in FIG. 1 is representative of multiple sinkers, each of which is individually received by a respective upwardly extending slot 18. As best seen in FIG. 1, the sinker 12 includes a lower nib 30 having a top surface 32, a bottom surface 34 and a leading edge 36. The sinker 12 further includes an upper nib 38 having a top surface 40, a bottom surface 42 and a leading edge 44. A nib slot 46 is defined between the top surface 32 of the lower nib 30 and the bottom surface 42 of the upper nib 38. The sinker 12 further includes a catch 48.

As mentioned above, the cylinder assembly 10 includes a separate sinker 12 extending at least partially into each of the upwardly extending slots 18. Each of the sinkers 12 is radially reciprocated within its respective upwardly extending slot 18 in response to the action of a cam (not shown). Two positions of a sinker 12 along the reciprocative travel path thereof are represented by the two broken-lined illustrations of a sinker in FIG. 2. Latch needles (not shown) reciprocate vertically and cooperate with the reciprocating sinkers 12 to produce knitted fabric (not shown) in a manner understood by those skilled in the art. Whereas only a single sinker 12 may be referred to in the following disclosure, the information provided with respect to that one sinker is representative of the other sinkers.

As best seen in FIG. 2, in accordance with the first embodiment of the present invention the composite receiving channel 24 is positioned so that the biased restricting member 26 therein closely overlies the lower nib 30 of the sinker 12 so as to prevent the sinker from riding upwardly due to lint or dirt accumulations on the upper face 19 of the cylindrical portion 14 or within the respective upwardly extending slot 18 (FIG. 1). More specifically, and with reference to FIGS. 1 and 2, as a sinker 12 reciprocates in its respective upwardly extending slot 18, the top surface 32 of the lower nib 30 slides across a bottom surface of the biased restricting member 26 in a bearing-like fashion such that the biased restricting member restricts upward movement of the sinker.

When there are two or more biased restricting members 26 within the composite receiving channel 24, or a single overlapping biased restricting member within the composite receiving channel, the surface or surfaces of the sinker 12 that contact the restricting member or members slide across multiple bearing-like surfaces of the biased restricting member or members, such that the biased restricting member or members provide a composite bearing-like surface that enhances and prolongs the optimal operation of the cylinder assembly 10.

As best seen in FIG. 1, in accordance with the first embodiment of the present invention the upper nib 38 does not come into contact with the biased restricting member 26. Thus, it is preferable for the bottom surface 34 of the sinker 12 to slide across the base wall of the respective upwardly extending slot 18 (FIG. 1) and the upper face 19 in a bearing-like fashion while the sinker reciprocates, so that the downward motion of the sinker is restricted.

In accordance with the first embodiment of the present invention, the biased restricting member 26 restrains the sinkers 12 from moving upwardly, so as to prevent the formation of "sinker lines" in the knitted fabric. Consequently, the need for trying to keep the upper regions of the cylindrical portion 14 clean, such as by means of forcing air into and near the slots 18, is at least partly reduced.

A significant advantage of the use of wires and/or springs as biased restricting members 26 is that the wires and springs are relatively inexpensive and easy to replace when worn. Ideally the wires or springs would last as long as possible, but as a minimum they only need to last as long as the sinkers 12, which are typically consumable elements that must be replaced every few months.

Second Embodiment

Figure 3:
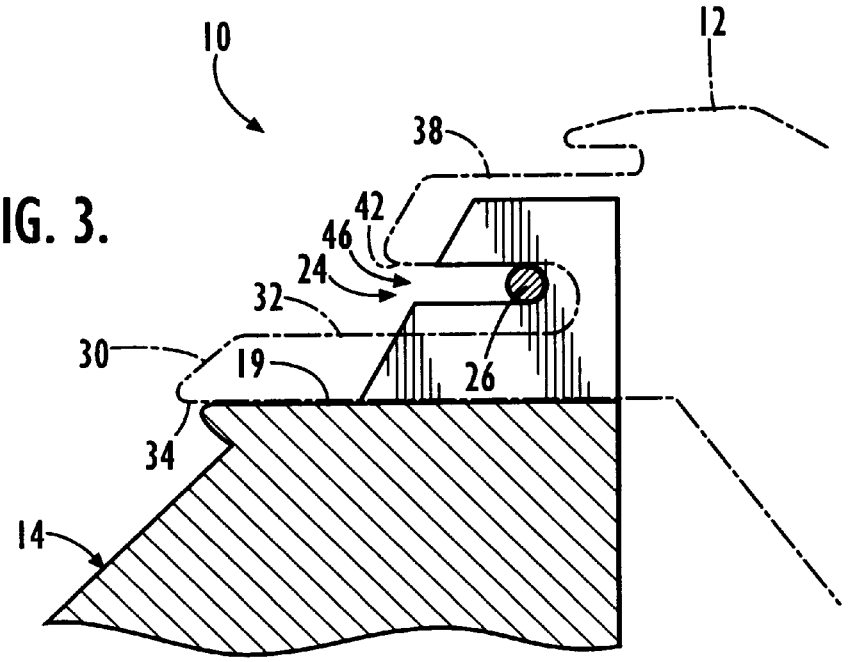
FIG. 3 is a sectional view of a portion of a cylinder assembly in accordance with a second embodiment of the present invention, wherein a sinker is shown in broken lines.

FIG. 3 illustrates portions of a cylinder assembly 10 and a portion of a sinker 12, which is shown by dashed lines, in accordance with a second embodiment of the present invention. The cylinder assembly 10 of the second embodiment of the present invention is identical to the cylinder assembly of the first embodiment of the present invention, except for variations that are noted and variations apparent to those skilled in the art.

In accordance with the second embodiment of the present invention, the receiving channel 24 and the biased restricting member 26 therein are positioned so that the upper nib 38 of the sinker 12 closely overlies the biased restricting member, so as to prevent the sinker from pivoting downward. More specifically, in accordance with the second embodiment of the present invention, the bottom surface 42 of the upper nib 38 slides across the top surface of the biased restricting member 26 in a bearing-like fashion so as to restrict downward movement of the sinker, while the sinker 12 reciprocates radially in its upwardly extending slot 18 (FIG. 1).

In accordance with a first version of the cylinder assembly 10 of the second embodiment of the present invention, the bottom surface 34 of the lower nib 30 slides across the base wall of the respective upwardly extending slot 18 (FIG. 1) and the upper face 19 in a bearing-like fashion as the sinker 12 reciprocates in its upwardly extending slot 18. However, it is preferred for the biased restricting member 26 to bear the brunt of the downward forces applied by the sinker 12 with respect to the cylindrical portion 14, so that any forces applied by the sinker against the base wall of the respective upwardly extending slot 18 and the upper face 19 are relatively small and cause a minimal amount of wear.

In accordance with a second version of the cylinder assembly 10 of the second embodiment, the receiving channel 24 and the biased restricting member 26 are positioned so that the biased restricting member bears all of the downward forces applied by the sinker with respect to the cylindrical portion 14. That is, the bottom surface 34 of the lower nib 30 of the sinker 12 preferably does not come into contact with the base wall of the respective upwardly extending slot 18 (FIG. 1) or the upper face 19.

In accordance with the second embodiment of the present invention, the biased restricting member 26 restrains the sinker 12 from moving downward, so as to prevent the formation of sinker lines in the fabric, to prevent problems such as smashing of the reciprocating needles and sinker parts, and to prevent wear to the base wall of the respective upwardly extending slot 18 (FIG. 1) and the upper face 19.

Third Embodiment

Figure 4:
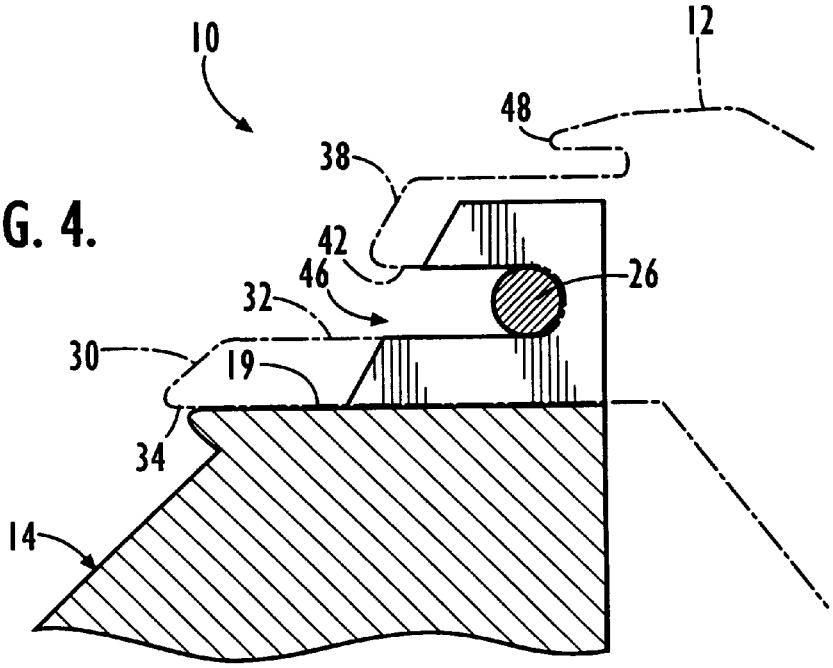
FIG. 4 is a sectional view of a portion of a cylinder assembly in accordance with a third embodiment of the present invention, wherein a sinker is shown in broken lines.

FIG. 4 illustrates portions of a cylinder assembly 10 and a portion of a sinker 12, which is shown by dashed lines, in accordance with a third embodiment of the present invention. The cylinder assembly 10 of the third embodiment of the present invention is identical to the cylinder assembly of the first embodiment of the present invention, except for variations that are noted and variations apparent to one skilled in the art. In accordance with the third embodiment of the present invention, the receiving channel 24 and the biased restricting member 26 therein are sized and positioned so that the top surface 32 of the lower nib 30 interacts with the biased restricting member as described for the first embodiment of the present invention, the bottom surface 42 of the upper nib 38 interacts with the biased restricting member as described for the second embodiment of the present invention, and the bottom surface 34 of the lower nib interacts with the base wall of the respective upwardly extending slot 18 (FIG. 1) and the upper face 19 as described for the second embodiment of the present invention.

Fourth Embodiment

Figure 5:
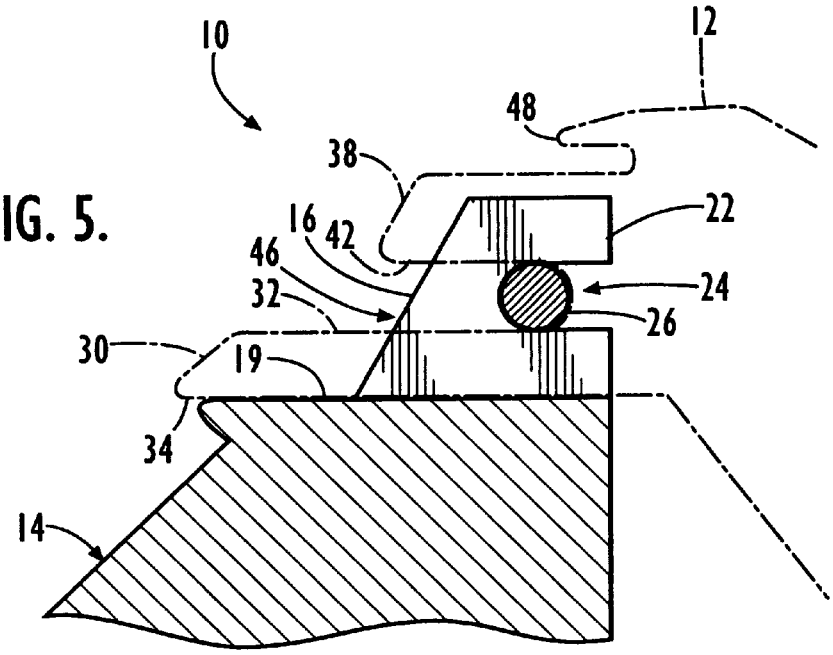
FIG. 5 is a sectional view of a portion of a cylinder assembly in accordance with a fourth embodiment of the present invention, wherein a sinker is shown in broken lines.

FIG. 5 illustrates portions of a cylinder assembly 10 and a portion of a sinker 12, which is shown by dashed lines, in accordance with a fourth embodiment of the present invention. The cylinder assembly 10 of the fourth embodiment of the present invention is identical to the cylinder assembly of the third embodiment of the present invention, except for variations that are noted in this disclosure and variations apparent to those skilled in the art.

In accordance with the fourth embodiment of the present invention, the composite receiving channel 24 defined by the upwardly extending protrusions 16 is oriented oppositely from the configuration illustrated in FIGS. 1–4. That is, in accordance with the fourth embodiment of the present invention, the opening of the horizontally or sideways oriented U-shaped receiving channel 24 is defined by the exterior surfaces 22 (also see FIG. 1) of the upwardly extending protrusions 16, such that the opening of the composite receiving channel encircles and is oriented away from the cylindrical axis of the cylindrical portion 14.

In accordance with the fourth embodiment of the present invention, the biased restricting member 26 is preferably circular or at least biased toward an arcuate or circular configuration. The relaxed diameter of the arc or circle defined by the biased restricting member 26 is preferably smaller than the diameter of the composite receiving channel 24, so that the biased restricting member becomes biasedly engaged to the arcuate wall that defines the base of the composite receiving channel. For example, when the biased restricting member 26 is a segment of wire, the wire is bent so that it is biased to a configuration having a diameter smaller than the diameter of the composite receiving channel 24, and then the wire is placed in the composite receiving channel, so that the wire becomes latchedly biased into the composite receiving channel.

It is within the scope of each of the embodiments of the present invention for the composite receiving channel 24 to be outwardly oriented, as in FIG. 5.

Fifth Embodiment

Figure 6:
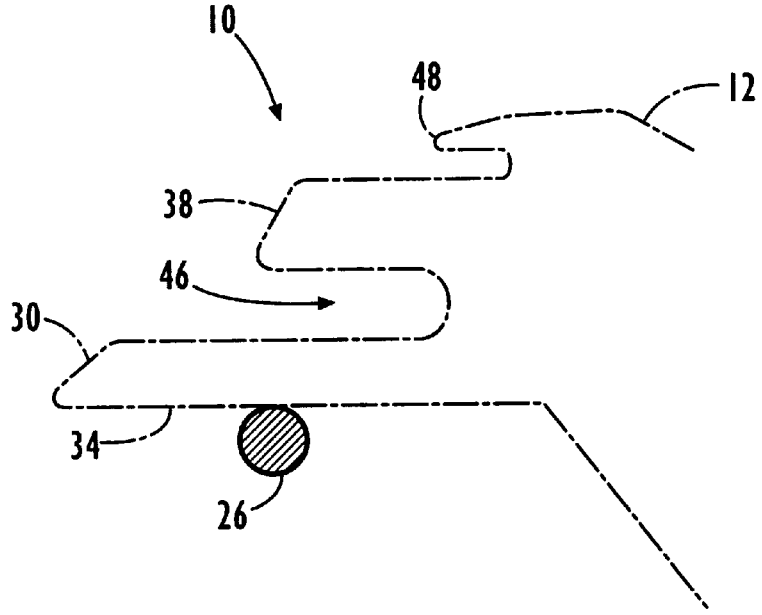
FIG. 6 is a sectional view of a portion of a biased restricting member of a cylinder assembly in accordance with a fifth embodiment of the present invention, wherein a sinker is shown in broken lines.

FIG. 6 illustrates portions of a cylinder assembly 10 and a portion of a sinker 12, which is shown by dashed lines, in accordance with a fifth embodiment of the present invention. The cylinder assembly 10 in accordance with a first version of the fifth embodiment of the present invention is identical to the cylinder assembly of the third embodiment of the present invention, and the cylinder assembly in accordance with a second version of the fifth embodiment of the present invention is identical to the cylinder assembly of the fourth embodiment of the present invention, except for variations that are noted and variations apparent to those skilled in the art.

In accordance with the fifth embodiment of the present invention, the lower nib 30 of the sinker 12 closely overlies the composite receiving channel 24 (FIGS. 1–5) and the biased restricting member 26 therein, so that the sinker is prevented from pivoting downward. More specifically, in accordance with the fifth embodiment of the present invention, the bottom surface 34 of the lower nib 30 of a sinker 12 slides across a top surface or surfaces of the biased restricting member 26 in a bearing-like fashion so as to restrict downward movement of the sinker, while the sinker 12 reciprocates in its upwardly extending slot 18 (FIG. 1).

In accordance with the fifth embodiment of the present invention, the composite receiving channel 24 and the biased restricting member 26 are positioned so that the biased restricting member bears all of the downward forces applied by the sinker 12 with respect to the cylindrical portion 14 (FIGS. 1–5). That is, the bottom surface 34 of the lower nib 30 does not come into contact with the base wall of the respective upwardly extending slot 18 (FIG. 1) or the upper face 19 (FIG. 1). Thus, the advantages provided by the fifth embodiment of the present invention correspond to the advantages provided by the second embodiment of the present invention.

In accordance with other embodiments of the present invention, advantages like those provided by the fifth embodiment of the present invention are achieved with a receiving channel and a restricting member positioned at or proximate to the upper face 19 of the cylindrical portion 14, as will be discussed in greater detail below.

Sixth Embodiment

Figure 7:
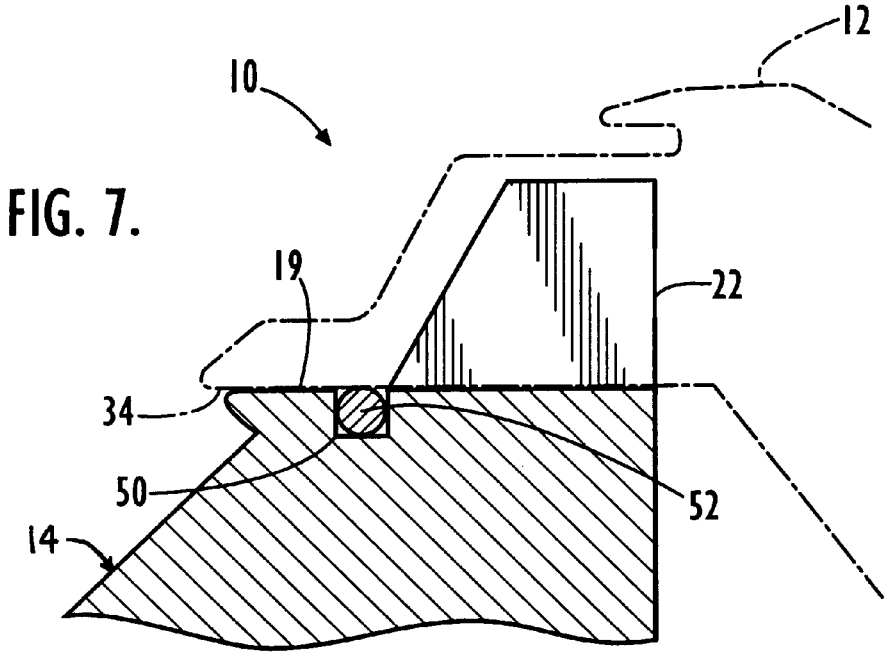
FIG. 7 is a sectional view of a portion of a cylinder assembly in accordance with a sixth embodiment of the present invention, wherein a sinker is shown in broken lines.

FIG. 7 illustrates portions of a cylinder assembly 10 and a portion of a sinker 12, which is shown by dashed lines, in accordance with a sixth embodiment of the present invention. The cylinder assembly 10 of the sixth embodiment of the present invention may be identical to the cylinder assembly of any of the first, second, third or fourth embodiments of the present invention (that is, in accordance with the sixth embodiment the cylinder assembly may include the receiving channel 24 (FIGS. 1–5) and the biased restricting member 26 (FIGS. 1–5)), except that in accordance with the sixth embodiment of the present invention the cylinder assembly further includes a receiving channel 50 and a restricting member 52. More specifically, in accordance with the sixth embodiment of the present invention, the cylindrical portion 14 defines the receiving channel 50, which is in receipt of the restricting member 52. Further, it is also within the scope of the sixth embodiment of the present invention for the cylinder assembly 10 not to include the receiving channel 24 and the restricting member 26.

More specifically, the receiving channel 50 can be characterized as a somewhat U-shaped channel that encircles the cylindrical axis of the cylindrical portion 14 and has an opening that is defined by the upper face 19 (also see FIG. 1) of cylindrical portion. The receiving channel 50 has, or is defined by, opposite and vertically extending inner and outer walls of the cylindrical portion 14 that extend upward from opposite sides of a base wall of the cylindrical portion, which provides the base of the receiving channel 50.

The restricting member 52, which may or may not be biased, is preferably an elongate, arcuate, or hoop-like member, such as a piece of wire, a spring or a spring-like piece of wire, or the like. The restricting member 52 is positioned in the receiving channel 50 and functions to provide a bearing-like surface that is engaged by the bottom surfaces 34 of the sinkers 12 and restricts undesired downward movement of the sinkers.

One example of an acceptable restricting member 52 is a length of wire having opposite ends. In accordance with one version of the sixth embodiment of the present invention, the piece of wire defines a circular shape having a diameter that corresponds to the diameter of the receiving channel 50, and the piece of wire is placed into the receiving channel 50. The force of gravity may maintain the piece of wire in the receiving channel 50, or, alternatively, the piece of wire may be press-fit into the receiving channel or secured in the receiving channel by other conventional means.

In accordance with another version of the sixth embodiment of the present invention, the piece of wire is biased toward a straight configuration such that when the wire is free from the receiving channel 50 the wire extends substantially or somewhat straight, or the piece of wire is biased toward an arcuate or somewhat circular configuration having a relaxed diameter that is larger than the diameter of the receiving channel 50. As a result, when the wire is manually placed in the receiving channel 50, the wire seeks to return to its relaxed configuration, which causes the wire to become biasedly engaged to the outer wall of the cylindrical portion 14 that defines the receiving channel, whereby the wire is engaged to the cylindrical portion 14. As shown by dashed lines in FIG. 8, the outer wall of the cylindrical portion 14 that defines the receiving channel 50 may be angled, so that a biased piece of wire is biased into an angled crotch defined between the outer and base walls of the cylindrical portion that define the receiving channel.

In accordance with another version of the sixth embodiment of the present invention, the piece of wire is biased toward an arcuate or somewhat circular configuration having a relaxed diameter that is smaller than the diameter of the receiving channel 50. As a result, when the wire is manually placed in the receiving channel 50, the wire seeks to return to its relaxed configuration, which causes the wire to become biasedly engaged to the inner wall of the cylindrical portion 14 that defines the receiving channel, whereby the wire is engaged to the cylindrical portion 14. As shown by dashed lines in FIG. 8, the inner wall of the cylindrical portion 14 that defines the receiving channel 50 may be angled, so that a biased piece of wire is biased into an angled crotch defined between the inner and base walls of the cylindrical portion that define the receiving channel.

The opposite ends of any somewhat circular or hoop-like piece of wire used in the receiving channel 50 may not be joined to one another, so that the wire has a discontinuous circumference. Alternatively, the opposite ends of such a piece of wire can be joined, such as by brazing or welding the ends together.

In accordance with another version of the sixth embodiment of the present invention, the restricting member 52 is an elongate helical spring that is wound so that it is in the form of an elongate, somewhat tube-like member which may be unbiased or biased toward any of the configurations described above with respect to the pieces of wire. Additionally, the opposite ends of the tube-like member may be attached to one another, such as by brazing or welding, so that the helical spring is in the form of a hoop or circle, or the like.

In accordance with another version of the sixth embodiment of the present invention, the restricting member is a hardened circular band having a substantially constant cross-sectional configuration, such as a substantially rectangular cross-sectional configuration, or a substantially circular cross-sectional configuration or other cross-sectional configurations. A suitable hardened circular band is disclosed in U.S. Pat. No. 5,577,401, which has previously been incorporated herein by reference.

Throughout this Detailed Description of the Invention section of this disclosure, unless expressly stated otherwise or understood otherwise by those skilled in the art, reference to a restricting member 52 within the receiving channel 50 is to be considered to alternatively include all of the variations of restricting members discussed above.

In accordance with the sixth embodiment of the present invention, the bottom surface 34 of the sinker 12 closely overlies the receiving channel 50 and the restricting member 52 therein, so that the sinker is prevented from pivoting downward. More specifically, in accordance with the sixth embodiment of the present invention, the bottom surface 34 of the sinker 12 slides across a top surface of the restricting member 26 in a bearing-like fashion so as to restrict downward movement of the sinker, while the sinker 12 reciprocates in its upwardly extending slot 18 (FIG. 1).

As mentioned above, the upper face 19 (also see FIG. 1) is preferably coplanar with the base walls of the slots 18 (FIG. 1), so as to define a first plane. In accordance with the sixth embodiment of the present invention, the receiving channel 50 and the restricting member 52 are positioned and sized so that the uppermost surface of the restricting member 52 is coplanar with the first plane, or most preferably the uppermost surface of the restricting member is at an elevation that is slightly above the first plane. That is, in accordance with the sixth embodiment of the present invention, the receiving channel 50 and the restricting member 52 are arranged so that the restricting member bears all of the downward forces applied by the sinker 12 with respect to the cylindrical portion 14 that would otherwise be born by the upper face 19 or the base walls of the slots 18. That is, in accordance with the sixth embodiment, the bottom surface 34 of the sinker 12 preferably does not come into contact with the base wall of the respective upwardly extending slot 18 or the upper face 19. Thus, the advantages provided by the sixth embodiment of the present invention correspond to the advantages provided by the second embodiment of the present invention.

Seventh Embodiment

Figure 8:
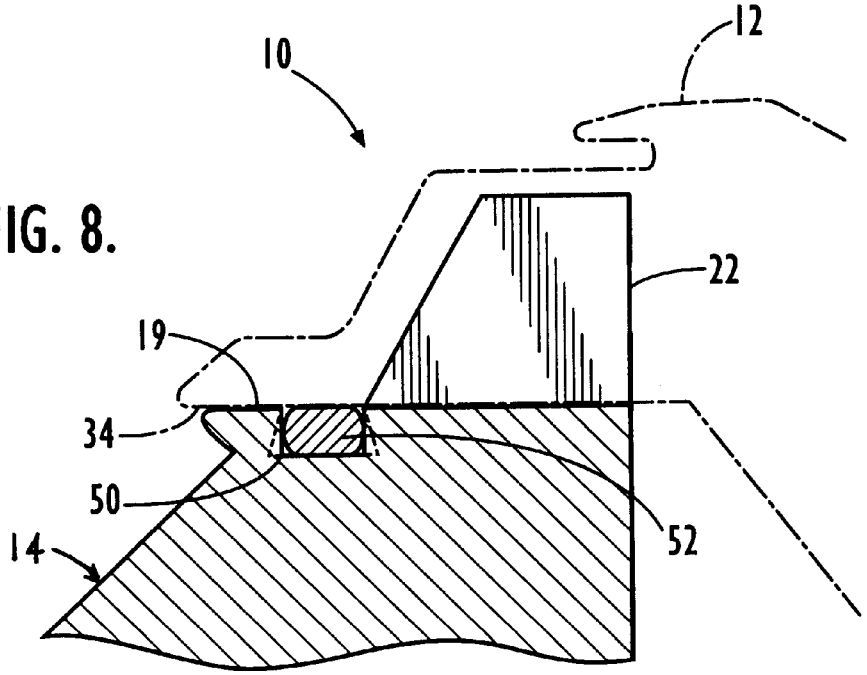
FIG. 8 is a sectional view of a portion of a cylinder assembly in accordance with a seventh embodiment of the present invention, wherein a sinker is shown in broken lines.

FIG. 8 illustrates portions of a cylinder assembly 10 and a portion of a sinker 12, which is shown by dashed lines, in accordance with a seventh embodiment of the present invention. The cylinder assembly 10 of the seventh embodiment of the present invention is identical to the cylinder assembly of the sixth embodiment of the present invention, except for variations that are noted in this disclosure and variations apparent to those skilled in the art.

In accordance with the seventh embodiment of the present invention, the upper and lower surfaces of the restricting member 52 are broad and flat in cross-sections of the restricting member. The broad and flat upper surface of the restricting member 52 provides an enlarged bearing-like surface that slidingly receives the bottom surface 34 of the sinker 12, and that enlarged bearing-like surface enhances and prolongs the optimal operation of the cylinder assembly 10. The broad and flat upper and lower surfaces of the restricting member 52 may be formed by forcing a restricting member having a round cross-section through a nip defined between shaping rollers, or similar conventional means, so that the restricting member becomes shaped as illustrated in FIG. 8. Alternatively, the broad and flat upper and lower surfaces of the restricting member 50 may be formed by machining material away from the upper and lower surfaces of a restricting member originally having a round cross-section.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A circular knitting machine, comprising:

a cylindrical portion;

a plurality of sinkers arranged for radial movement along respective travel paths at an upper portion of the cylindrical portion;

a channel defined at an upper portion of the cylindrical portion in the travel paths of the sinkers;

a slot formed in a leading edge of each of the sinkers, wherein the slots are at a level coincident with the channel; and at least one replaceable restricting means biasingly engaged within the channel such that the slots at least partially receive the restricting means and the restricting means restricts undesired vertical movement of the sinkers in at least one direction, during radial movement of the sinkers.

2. A circular knitting machine according to claim 1, wherein the restricting means has a substantially circular cross-sectional configuration.

3. A circular knitting machine according to claim 1, wherein the engagement between the cylindrical portion and the restricting means is such that the restricting means remains substantially stationary during the radial movement of the sinkers.

4. A circular knitting machine according to claim 1, wherein the restricting means is biased such that the restricting means is substantially straight while separate from the cylindrical portion and unrestrained.

5. A circular knitting machine according to claim 1, wherein:

the channel defines a first diameter, the restricting means is biased such that the restricting means at least partially defines an arcuate configuration, which defines a second diameter, while the biased restricting member is separate from the channel and unrestrained, and the second diameter is different from the first diameter.

6. A circular knitting machine according to claim 1, wherein the cylindrical portion comprises a plurality of spaced-apart, radially extending protrusions, and a plurality of radially extending slots are defined between the protrusions, wherein the radially extending slots are operative for at least partially receiving the sinkers, and the protrusions at least partially define the channel.

7. A circular knitting machine according to claim 6, wherein the restricting means at least partially bisects the radially extending slots.

8. A circular knitting machine, comprising:

a cylindrical portion having a cylindrical axis;

a biased restricting member biasingly engaged to the cylindrical portion and extending at least partially around the cylindrical axis, the biased restricting member comprising a surface; and a plurality of sinkers operative for reciprocating radially relative to the cylindrical portion and the biased restricting member such that sliding contact is defined between the sinkers and the surface of the biased restricting member, and the biased restricting member is operative to restrict movement of the sinkers in at least a first direction that extends substantially in the direction of the cylindrical axis.

9. A circular knitting machine according to claim 8, wherein the biased restricting member is further operative to restrict movement of the sinkers in a second direction that is opposite from the first direction and extends substantially in the direction of the cylindrical axis.

10. A circular knitting machine according to claim 8, wherein the biased restricting member comprises a spring.

11. A circular knitting machine according to claim 8, wherein the biased restricting member has a substantially circular cross-sectional configuration.

12. A circular knitting machine according to claim 8, wherein the biased restricting member is in the shape of a hoop.

13. A circular knitting machine according to claim 8, wherein the biased restricting member has a discontinuous circumference.

14. A circular knitting machine according to claim 8, wherein the engagement between the cylindrical portion and the biased restricting member is such that the biased restricting member remains substantially stationary during the reciprocating of the sinkers.

15. A circular knitting machine according to claim 8, wherein the cylindrical portion comprises first and second surfaces that extend at least partially around the cylindrical axis, the biased engagement of the biased restricting member is with respect to at least the first surface and the biased restricting member is further engaged with at least the second surface which is operative to restrict movement of the biased restricting member in at least the first direction, whereby at least the second surface slidingly contacts the biased restricting member so as to restrict movement of the sinkers in at least the first direction.

16. A circular knitting machine according to claim 8, wherein the biasing of the biased restricting member is such that the biased restricting member is substantially straight while the biased restricting member is separate from the cylindrical portion and unrestrained.

17. A circular knitting machine according to claim 8, wherein each of the sinkers comprises a lower surface, and the lower surfaces of the sinkers and the biased restricting member are operative to engage one another to restrict movement of the sinkers in the first direction.

18. A circular knitting machine according to claim 8, wherein:

the cylindrical portion defines a channel that extends at least partially around the cylindrical axis, and the biased restricting member is at least partially within the channel;

the cylindrical portion comprises a surface that extends at least partially around the cylindrical axis and defines an opening to the channel, and the opening extends at least partially around the cylindrical axis so as to allow for introduction of the biased restricting member into the channel and removal of the biased restricting member from the channel, whereby the biased restricting member is readily replaceable; and the cylindrical portion further comprises a plurality of spaced-apart, radially extending protrusions that extend around the opening to the channel, wherein a plurality of radially extending slots are defined between the protrusions, and the slots at least partially receive the sinkers.

19. A circular knitting machine according to claim 18, wherein the plurality of protrusions extend upward from proximate to the surface.

20. A circular knitting machine according to claim 8, wherein:

the cylindrical portion defines a channel that extends at least partially around the cylindrical axis;

the circular knitting machine further comprises a second restricting member that is at least partially within the channel, and the plurality of sinkers further reciprocate radially relative to the second restricting member such that sliding contact is defined between the sinkers and the second restricting member, and the second restricting member is operative to restrict movement of the sinkers in at least a second direction that is opposite from the first direction and extends substantially in the direction of the cylindrical axis; and the cylindrical portion comprises a surface that extends at least partially around the cylindrical axis and defines an opening to the channel, and the opening extends at least partially around the cylindrical axis so as to allow for introduction of the second restricting member into the channel and removal of the second restricting member from the channel, whereby the second restricting member is readily replaceable.

21. A circular knitting machine according to claim 20, wherein the cylindrical portion further comprises a plurality of spaced-apart, radially extending protrusions that extend upward from proximate to the surface and extend around the opening to the channel, a plurality of radially extending slots are defined between the protrusions, and the slots at least partially receive the sinkers.

22. A circular knitting machine according to claim 8, wherein:

each of the sinkers defines a radially extending slot; and the reciprocating of the sinkers defines respective travel paths, and the biased restricting member is positioned at least partially within the travel paths so that the biased restricting member is at least partially received within the radially extending slots in response to the reciprocating.

23. A circular knitting machine according to claim 22, wherein each of the sinkers comprises an upper nib and a lower nib, the radially extending slot is defined between the upper nib and the lower nib, and the upper nib and the biased restricting member are operative to engage one another to restrict movement of the sinker in the first direction.

24. A circular knitting machine according to claim 22, wherein each of the sinkers comprises an upper nib and a lower nib, the radially extending slot is defined between the upper nib and the lower nib, and the lower nib and the biased restricting member are operative to engage one another to restrict movement of the sinker in the first direction.

25. A circular knitting machine according to claim 24, wherein the upper nib and the biased restricting member are operative to engage one another to restrict movement of the sinker in a second direction that is opposite from the first direction and extends substantially in the direction of the cylindrical axis.

26. A circular knitting machine according to claim 8, wherein the cylindrical portion defines a channel that extends at least partially around the cylindrical axis, and the biased restricting member is at least partially within the channel and is biased against a bottom surface of the channel so as to remain in the channel.

27. A circular knitting machine according to claim 26, wherein:

the cylindrical portion comprises an interior surface that extends at least partially around and at least partially faces the cylindrical axis; and the interior surface at least partially defines an opening to the channel, and the opening extends at least partially around the cylindrical axis so as to allow for introduction of the biased restricting member into the channel and removal of the biased restricting member from the channel, whereby the biased restricting member is readily replaceable.

28. A circular knitting machine according to claim 26, wherein:

the cylindrical portion comprises an exterior surface that extends at least partially around and at least partially faces away from the cylindrical axis; and the exterior surface at least partially defines an opening to the channel, and the opening extends at least partially around the cylindrical axis so as to facilitate introduction the biased restricting member into the channel and removal of the biased restricting member from the channel, whereby the biased restricting member is readily replaceable.

29. A circular knitting machine according to claim 26, wherein the cylindrical portion comprises a plurality of spaced-apart, radially extending protrusions, a plurality of radially extending slots are defined between the protrusions, the slots at least partially receiving the sinkers, and the protrusions at least partially define the channel.

30. A circular knitting machine according to claim 29, wherein the biased restricting member at least partially bisect the slots.

31. A circular knitting machine according to claim 26, wherein:

the channel defines a first diameter, the biased restricting member is biasing such that the biased restricting member at least partially defines an arcuate configuration, which defines a second diameter, while the biased restricting member is separate from the channel and unrestrained, and the second diameter is different from the first diameter.

32. A circular knitting machine according to claim 31, wherein the first diameter is larger than the second diameter.

33. A circular knitting machine according to claim 31, wherein the first diameter is smaller than the second diameter.

34. A cylinder assembly for a circular knitting machine of the type incorporating sinkers, the cylinder assembly comprising:

a cylindrical portion having a cylindrical axis, wherein the cylindrical portion comprises a plurality of spaced-apart, radially extending protrusions, a plurality of radially extending slots are defined between the protrusions, and the slots are operative for at least partially receive the sinkers; and a biased restricting member biasingly engaged to the cylindrical portion such that the biased restricting member extends at least partially around the cylindrical axis and is positioned to provide a bearing-like surface for the sinkers received by the slots.

35. A cylinder assembly according to claim 34, wherein the biased restricting member at least partially extends through the slots.

36. A cylinder assembly according to claim 34, wherein the biased restricting member has a substantially circular cross-sectional configuration.

37. A cylinder assembly according to claim 34, wherein the biased restricting member has a discontinuous circumference.

38. A cylinder assembly according to claim 34, wherein the cylindrical portion comprises first and second surfaces that extend at least partially around the cylindrical axis, the biased engagement of the biased restricting member is with respect to at least the first surface and the biased restricting member is further engaged with at least the second surface which is operative to restrict movement of the biased restricting member in at least a first direction that extends substantially in the direction of the cylindrical axis.

39. A cylinder assembly according to claim 34, wherein the protrusions at least partially define a channel that extends at least partially around the cylindrical axis, and the biased restricting member is at least partially within the channel and biased against a surface of the channel so as to remain in the channel.

40. A cylinder assembly according to claim 39, wherein:

the channel defines a first diameter, the biased restricting member is biased such that the biased restricting member at least partially defines an arcuate configuration, which defines a second diameter, while the biased restricting member is separate from the channel and unrestrained, and the second diameter is different from the first diameter.

41. A circular knitting machine according to claim 34, wherein:

the cylindrical portion defines a channel that extends at least partially around the cylindrical axis, and the biased restricting member is at least partially within the channel; and the cylindrical portion comprises a surface that extends at least partially around the cylindrical axis and defines an opening to the channel, and the opening extends at least partially around the cylindrical axis so as to allow for introduction of the biased restricting member into the channel and removal of the biased restricting member from the channel, whereby the biased restricting member is readily replaceable.

42. A circular knitting machine according to claim 41 wherein the plurality of protrusions extend around the channel and extend upward from proximate to the surface.

43. A circular knitting machine according to claim 34, wherein:

the cylindrical portion defines a channel that extends at least partially around the cylindrical axis;

the circular knitting machine further comprises a second restricting member that is at least partially within the channel and is operative to provided a bearing-like surface for the sinkers; and the cylindrical portion comprises a surface that extends at least partially around the cylindrical axis and defines an opening to the channel, and the opening extends at least partially around the cylindrical axis so as to allow for introduction of the second restricting member into the channel and removal of the second restricting member from the channel, whereby the second restricting member is readily replaceable.

44. A circular knitting machine according to claim 43, wherein the plurality of protrusions extend upward from proximate to the surface and encircle the channel.

45. A cylinder assembly for a circular knitting machine of the type incorporating sinkers, the cylinder assembly comprising:

a cylindrical portion having a cylindrical axis, wherein the cylindrical portion comprises a plurality of spaced-apart, radially extending protrusions, a plurality of radially extending slots are defined between the protrusions, and the slots are operative for at least partially receiving the sinkers; and a replaceable restricting member carried by the cylindrical portion such that the restricting member extends at least partially around the cylindrical axis and is positioned to provide a bearing-like surface for the sinkers received by the slots, wherein the plurality of protrusions extend around the restricting member and the restricting member can be removed from the plurality of protrusions.

46. A cylinder assembly according to claim 45, wherein the cylindrical portion at least partially defines a channel that extends at least partially around the cylindrical axis, and the biased restricting member is at least partially within the channel.

47. A cylinder assembly according to claim 46, wherein the restricting member is biased against a surface of the channel so as to remain in the channel.

48. A circular knitting machine according to claim 46, wherein the cylindrical portion comprises a surface that extends at least partially around the cylindrical axis and defines an opening to the channel, and the opening extends at least partially around the cylindrical axis so as to allow for introduction of the biased restricting member into the channel and removal of the biased restricting member from the channel, whereby the biased restricting member is readily replaceable.

49. A circular knitting machine according to claim 48, wherein the plurality of protrusions extend around the channel and extend upward from proximate to the surface.

50. A method of restricting undesirable movement of sinkers with respect to a cylindrical portion, which has a cylindrical axis, of a circular knitting machine, the method comprising the steps of:

bending a biased restricting member and releasing the biased restricting member so that the bias of the released biased restricting member causes the biased restricting member to become biasingly engaged to the cylindrical portion; and reciprocating a plurality of sinkers radially relative to the cylindrical portion and the biased restricting member such that sliding contact is defined between the sinkers and the biased restricting member, and the biased restricting member restricts movement of the sinkers in at least a one direction that extends substantially in the direction of the cylindrical axis.

51. A method according to claim 50, wherein the reciprocating step comprises moving at least one sinker so that the position of the biased restricting member within a slot defined in the sinker is varied.

* * * * *